US006484340B2

(12) United States Patent
Kutschi

(10) Patent No.: US 6,484,340 B2
(45) Date of Patent: Nov. 26, 2002

(54) VENTILATED MATTRESS CORE

(76) Inventor: Franz Kutschi, Sportplatzstrasse 16, A-8580 Köflach (AT)

( * ) Notice: Subject to any disclaimer, the term of this patent is extended or adjusted under 35 U.S.C. 154(b) by 0 days.

(21) Appl. No.: 09/817,790

(22) Filed: Mar. 27, 2001

(65) Prior Publication Data

US 2001/0044972 A1 Nov. 29, 2001

(51) Int. Cl.[7] ..... A97C 27/05
(52) U.S. Cl. ..... 5/716; 5/724; 5/718
(58) Field of Search ..... 5/709, 716, 718, 5/719, 720, 724, 652.1, 655.8

(56) References Cited

U.S. PATENT DOCUMENTS 2,321,790 A * 6/1943 Bass ..... 5/719
2,922,466 A * 1/1960 Marston ..... 5/652.1
3,251,078 A * 5/1966 Calla ..... 5/718
4,862,540 A * 9/1989 Savenije ..... 5/718
6,170,808 B1 * 1/2001 Kutschi ..... 5/718

FOREIGN PATENT DOCUMENTS

AT 405481 * 1/1999

* cited by examiner

*Primary Examiner*—Michael F. Trettel
(74) *Attorney, Agent, or Firm*—Fulbright & Jaworski

(57) ABSTRACT

The invention relates to a mattress core made from foamed material, latex, or plastic being provided with a series of hollow spaces (2) running perpendicular to its longitudinal axis. According to the invention, it is provided that coil springs (3) are positioned in a lying fashion in the hollow spaces (2) running perpendicularly to the longitudinal axis of the foam core (1). Preferably, the coil springs (3) are produced from a tape material and a fibrous composition material and foamed in.

18 Claims, 1 Drawing Sheet

VENTILATED MATTRESS CORE

BACKGROUND OF THE INVENTION

1. Field of the Invention

The invention relates to a mattress cores. More particularly, the invention relates to mattress cores made from foamed material, latex, or plastic and provided with a series of hollow spaces running perpendicularly to the mattress' longitudinal axis.

2. Description of the Related Technology

Mattress cores made from foamed materials have been known for a long period of time. The composition of such mattress cores mostly comprise leveled or profiled plane elements made from foamed material of equal or different firmness.

Through such construction, reclining characteristics improved; however, sufficient ventilation and moisture removal could not be achieved because the pressure caused by the sinking of the user deformed any channels provided in the cores such that good ventilation and moisture removal was prevented.

Exemplary prior art mattress cores are disclosed in AT PS 361 165 and AT PS 370 603. These prior art mattress cores also fail to provide good ventilation and moisture removal since too little air is available due to the small diameters of the hollow spaces. Thus, for removing moisture, expensive lath grids are still necessary. Furthermore, even without gluing compact mattresses, good ventilation cannot be produced due to the multi-layered construction.

SUMMARY OF THE INVENTION

The present invention overcomes the practical problems described above and offers new advantages as well. It is therefore an object of the present invention to provide a mattress core adapted to facilitate ventilation and/or moisture removal. This and other objects of the invention are accomplished by the provision of hollow spaces in a mattress core, wherein coil springs are disposed in the hollow spaces. Preferably, the coil springs comprise a fibrous material.

By the relatively rigid design and suitable arrangement of the coil spring according to the invention, a continuous flexible reinforcement of a mattress core hollow space is created. Preferably, the hollow spaces are configured to be large enough to house a sufficient volume of air for effective ventilation. Furthermore, the coil spring according to the invention preferably prevents a collapsing of the hollow spaces under the pressure of a user, thereby ensuring lateral ventilation during use. Accordingly, another advantage of the present invention is the possible omission of expensive lath grids.

Construction and sizing of the coil spring according to the invention are preferably such that the spring force of the coil spring (stressed in a lying position) is equivalent to the opposite pressure force caused by the mattress core material, removed by the hollow space, to ensure an optimum reclining comfort without sinking in the region of the hollow space. The coil spring preferably operates as a stent, or reinforcement, to allow a hollow space to resist collapsing under the weight of a user, without sacrificing comfort.

A particularly advantageous embodiment is provided when at the ends of consecutive hollow spaces, alternating recesses are configured to create a continuous hollow space that can be ventilated from the outside (inwardly and/or outwardly). Accordingly, this results in another advantage; in winter the mattress core can be heated via warm air and in summer it can be cooled via cold air.

Another advantageous embodiment according to the invention is provided when the mattress core is configured as a compact mattress and the cover material is connected to the mattress core material via needle bonding, thus creating a high quality mattress without glue.

The invention as described and claimed herein should become evident to a person of ordinary skill in the art given the following enabling description and drawings. The following enabling disclosure is directed to one of ordinary skill in the art and presupposes that those aspects of the invention within the ability of the ordinarily skilled artisan are understood and appreciated.

BRIEF DESCRIPTION OF THE DRAWINGS

In the following, the invention is explained in greater detail using the exemplary embodiment shown in the drawings wherein.

DESCRIPTION OF THE PREFERRED EMBODIMENTS

Figure 1:
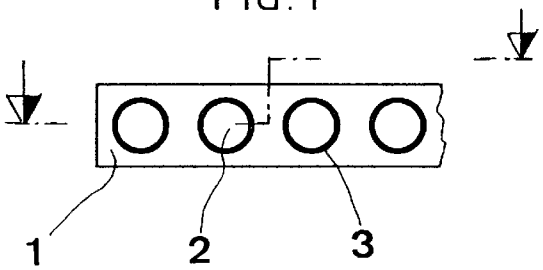
FIG. 1 depicts a partial side view of an embodiment of a mattress core according to the invention.
Figure 2:
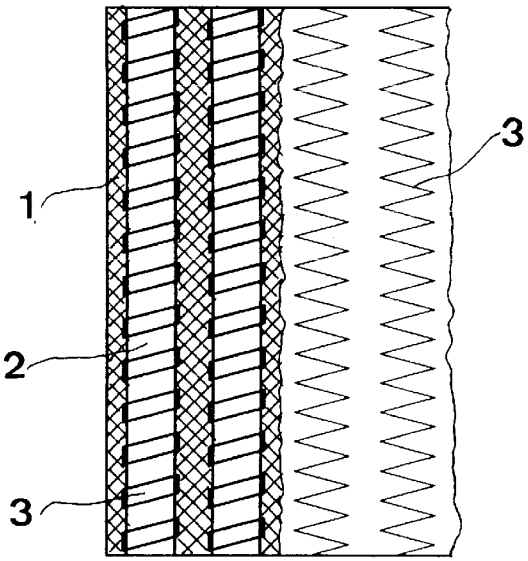
FIG. 2 depicts a partial top view, in partial cross-section, of an embodiment of a mattress core according to the invention.

As discernible from FIG. 1, the mattress core according to the invention is provided with a homogeneous foam core (1) having hollow spaces (2) embedded therein. Preferably, the hollow spaces (2) are arranged in series perpendicular to the longitudinal axis. Positioned within the hollow spaces (2) are coil springs (3). As best depicted in FIG. 2, coil springs (3) are positioned in the hollow spaces (2) and the coil springs (3) are adjusted to conform to the shape of the hollow space (2).

Figure 3:
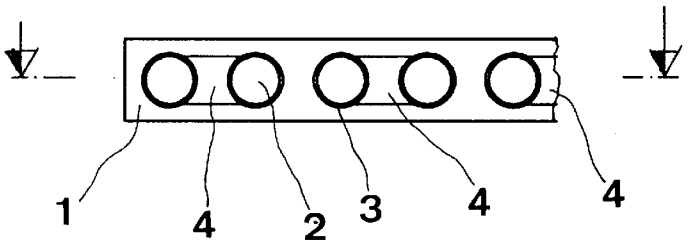
FIG. 3 depicts a partial side view of an alternative embodiment of a mattress core according to the invention.
Figure 4:
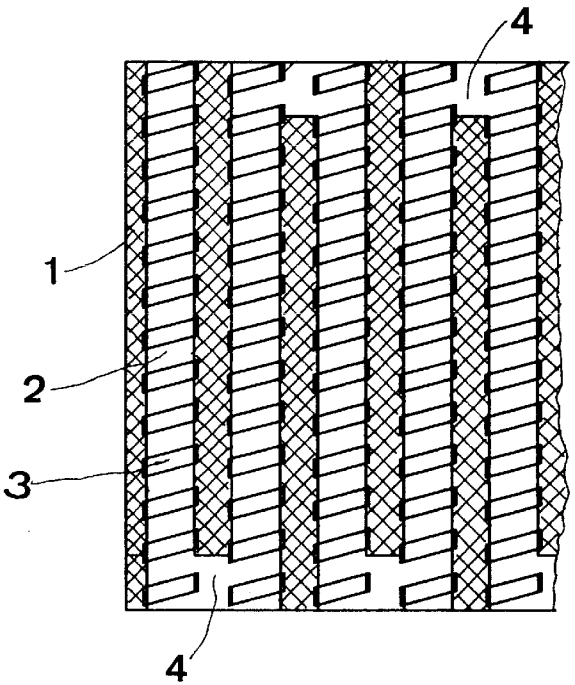
FIG. 4 depicts a cross-sectional, partial top view of an alternative embodiment of a mattress core according to the invention.

FIG. 3 shows an embodiment of the mattress core according to the invention, wherein the mattress has a foam core (1), hollow spaces (2) and recesses (4) alternatively provided at the ends of two hollow spaces (2). As depicted in FIG. 4, the recesses (4) provided at the ends of the consecutive hollow spaces (2) are alternatively positioned such that a continuous hollow space of is formed.

What is claimed is:

1. A mattress body comprising:

a mattress core including a plurality of continuous hollow spaces, each continuous hollow space is disposed in said mattress body to be parallel to a top surface and a bottom surface of said mattress body;

a plurality of coil springs, wherein each continuous hollow space is provided with one of said coil springs disposed longitudinally parallel to said top and bottom surfaces of said mattress body.

2. The mattress body of claim 1, wherein said continuous hollow spaces are spaced apart from one another and are disposed generally perpendicular to a longitudinal axis of said mattress core.

3. The mattress body of claim 2, wherein said hollow spaces are generally parallel to each other.

4. The mattress body of claim 1, wherein said mattress core comprises a foam material, a latex material, or a plastic material.

5. The mattress body of claim 1, wherein said coil springs comprise a relatively rigid material.

6. The mattress body of claim 5, wherein said relatively rigid material is a fibrous material.

7. The mattress body of claim 1, wherein each of said coil springs has a spring force along a direction perpendicular to said top surface and said bottom surface that is equivalent to a pressure force for mattress body material of construction removed from said mattress core to provide for said continuous hollow space; whereby said continuous hollow spaces with said coil springs resist collapsing under a weight of a user by an equivalent force to that of said removed material of construction.

8. The mattress body of claim 1, wherein said coil springs comprise a foamed-in tape material.

9. The mattress body of claim 1, wherein said coil springs are configured to conform to the shape of said continuous hollow spaces.

10. The mattress body of claim 1, wherein said continuous hollow spaces are configured to house a predetermined volume of air.

11. The mattress body of claim 1, wherein said continuous hollow spaces are adapted for ventilation from outside said mattress body and into said mattress body.

12. A mattress body comprising:

a mattress core including a plurality of continuous hollow spaces, each continuous hollow space is disposed in said mattress body to be parallel to a top surface and a bottom surface of said mattress body;

a plurality of coil springs, wherein each continuous hollow space is provided with one of said coil springs disposed longitudinally parallel to said top and bottom surfaces of said mattress body; and said mattress core further including a plurality of recesses, such that a recess as disposed at alternating end areas between two of said continuous hollow spaces.

13. The mattress of claim 12, wherein said continuous hollow spaces are adapted to provide continuous ventilation from outside said mattress body and into said mattress body.

14. The mattress body of claim 12, wherein said mattress core comprises a foam material, a latex material, or a plastic material.

15. The mattress body of claim 12, wherein each of said coil springs has a spring force along a direction perpendicular to said top surface and said bottom surface that is equivalent to a pressure force for mattress body material of construction removed from said mattress core to provide for said continuous hollow space, whereby said continuous hollow spaces with said coil springs resist collapsing under a weight of user by an equivalent force to that of said removed material of construction.

16. The mattress body of claim 12, wherein said coil springs comprise a tape material and said material is foamed in.

17. The mattress body of claim 12, wherein said coil springs are configured to conform to the shape of the continuous hollow spaces.

18. The mattress body of claim 12, wherein said continuous hollow spaces are configured to house a predetermined volume of air.

* * * * *